US007272328B2

(12) United States Patent
Ream et al.

(10) Patent No.: US 7,272,328 B2
(45) Date of Patent: Sep. 18, 2007

(54) DEVELOPMENT COMPONENT DETECTION IN AN ELECTROPHOTOGRAPHIC DEVICE

(75) Inventors: Gregory Lawrence Ream, Lexington, KY (US); Mark Kevin DeMoor, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 282 days.

(21) Appl. No.: 11/093,143

(22) Filed: Mar. 29, 2005

(65) Prior Publication Data

US 2006/0227359 A1 Oct. 12, 2006

(51) Int. Cl.
*G03G 15/00* (2006.01)

(52) U.S. Cl. ..... 399/13; 399/37

(58) Field of Classification Search ..... 399/12, 399/13, 81, 85, 82, 88, 90, 37
See application file for complete search history.

(56) References Cited

U.S. PATENT DOCUMENTS

| | | | | |
|---|---|---|---|---|
| 5,225,870 | A | 7/1993 | Tanimoto et al. | |
| 5,617,188 | A | 4/1997 | Inomata | |
| 5,862,430 | A | 1/1999 | Mitekura et al. | |
| 5,909,603 | A | 6/1999 | Suziki et al. | |
| 6,029,018 | A | 2/2000 | Rogers, IV et al. | |
| 6,029,019 | A | 2/2000 | Kawai | |
| 6,137,966 | A | 10/2000 | Uehara et al. | |
| 6,201,935 | B1 | 3/2001 | Terada et al. | |
| 6,226,476 | B1 | 5/2001 | Miyabe et al. | |
| 6,311,025 | B1 | 10/2001 | Nagata et al. | |
| 6,311,026 | B1 | 10/2001 | Higeta et al. | |
| 6,408,142 | B1 | 6/2002 | Takeuchi et al. | |
| 6,763,198 | B2 | 7/2004 | Matsumoto | |
| 7,092,653 | B2 * | 8/2006 | Yoshizuka et al. | 399/81 |
| 2002/0191981 | A1 | 12/2002 | Miyabe et al. | |
| 2004/0008997 | A1 | 1/2004 | Yoshimoto | |
| 2004/0253008 | A1 | 12/2004 | Chapman et al. | |
| 2005/0105922 | A1 * | 5/2005 | Kawai | 399/12 |

FOREIGN PATENT DOCUMENTS

| | | |
|---|---|---|
| JP | 11-237814 | 8/1999 |

* cited by examiner

*Primary Examiner*—Hoang Ngo
(74) *Attorney, Agent, or Firm*—Coates & Bennett, PLLC

(57) ABSTRACT

An image forming device and method of detecting the presence or absence of components of one or more image forming units. Each image forming unit includes a replaceable component. A power supply transmits an input signal to the replaceable component. A detection circuit is coupled to the replaceable component and generates an output signal indicative of the presence or absence of an electrical coupling that is established when the replaceable component is installed. The detection circuit thus senses the input signal propagating through the replaceable component. A controller may be adapted to halt image formation or generate an error indication if the detection circuit detects the absence of necessary components or the presence of components not necessary for a current mode of operation.

23 Claims, 7 Drawing Sheets

DEVELOPMENT COMPONENT DETECTION IN AN ELECTROPHOTOGRAPHIC DEVICE

BACKGROUND

Image forming devices are comprised of a multitude of various electrical, mechanical, and optical devices. It is typically the case that all of the components of the image forming device must be properly installed for the image forming device to function properly. There are some exceptions. For instance, in an image forming device having a plurality of media trays, it may be possible for the image forming device to function properly if one or more trays are removed from the image forming device if there is at least one tray with a sufficient amount of media installed in the image forming device.

Similarly, it may be possible for color image forming devices to operate even though one or more toner cartridges is empty or completely removed. As an example, some color electrophotographic imaging devices have four developer cartridges, each cartridge containing a different color toner and perhaps other developer components such as a developer roll and a photoconductive member. A common color scheme found in color image forming devices uses cyan, magenta, yellow, and black developer cartridges. In color image forming devices such as these, it may be possible to operate in a black-only mode if one or more of the non-black developer cartridges is absent from the color image forming device. It is useful in such a scenario to detect the presence or absence of each of the toner cartridges to determine the allowable operating modes (e.g., black-only, full color, or partial color). Some common techniques for detecting the presence or absence of components include mechanical switches, optical sensors, and electrical or electromagnetic devices such as proximity sensors that use an RF or other distinctive signature. However, there are instances where the use of these types of detectors is impractical because of cost, space, or reliability concerns.

SUMMARY

Embodiments of the present invention are directed to sensing the presence or absence of components of one or more removable image forming units in an image forming device. An image forming unit may comprise a removable component. An associated power supply is adapted to apply an input signal to the removable component. Sense circuitry coupled to the removable component of the one or more image forming units may sense the application of the input signal when the removable component is properly installed. The removable cartridge may comprise a photoconductive member, a transfer roller, a developer roller, or some combination of these imaging components. Further, these imaging components may be disposed in separate customer replaceable units. The image forming device may also include control circuitry that halts image formation if the sense circuitry fails to sense the presence of necessary image forming unit components. Similarly the control circuitry may halt image formation if the sense circuitry senses the presence of image formation unit components not necessary for a current mode of operation.

The image forming device may be configured to operate in a black-only mode using a single image forming unit. The image forming device may also be a color image forming device with multiple image forming units corresponding to different colors. The controller may therefore control image formation in different color modes by sensing the presence or absence of necessary and unnecessary components.

DETAILED DESCRIPTION

Figure 1:
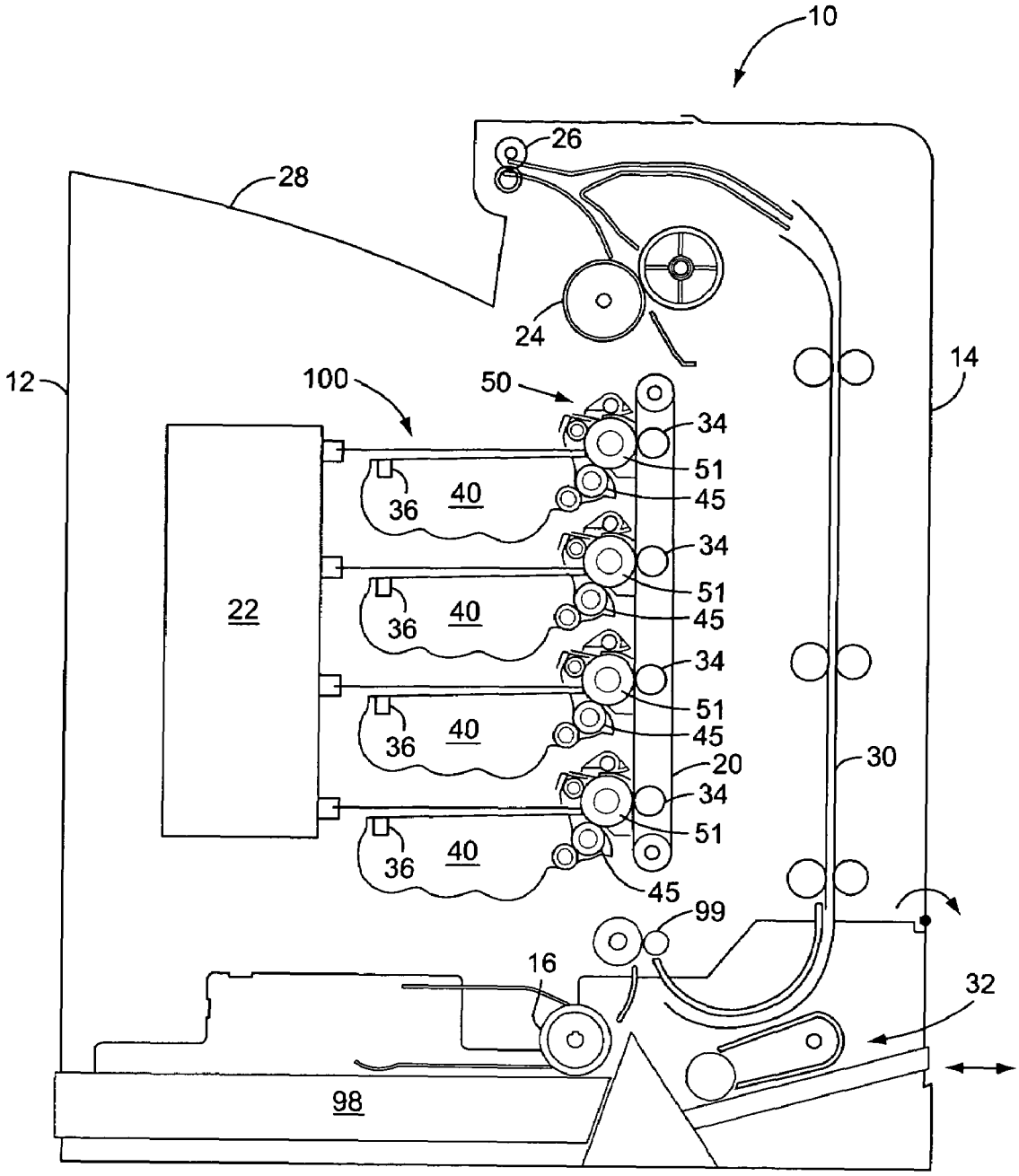
FIG. 1 is a schematic view of an image forming device according to one embodiment of the present invention.

The present invention is directed to an apparatus and related method for determining the presence or absence of components in an image forming device 10, such as a printer of the type illustrated in FIG. 1. The representative image forming device, indicated generally by the numeral 10, comprises a main body 12, including an access door 14 and internal components operative to produce color images on individual media sheets. A media tray 98 with a pick mechanism 16, or a multi-purpose feeder 32, are conduits for introducing media sheets into the device 10. The media tray 98 is located on a lower section of the main body 12 and is preferably removable for refilling.

Media sheets are moved from the input and fed into a primary media path. One or more registration rollers 99 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms a latent image on a photoconductive member 51 within the image forming units 100. At each image forming unit 100, the latent images are developed by a developer member 45 that supplies and transfers toner to the photoconductive member 51. The developed image, which is comprised at this point of loose, but electrostatically charged toner is then transferred to media sheets with the aid of a transfer roller 34. The media sheet with loose toner is then moved through a fuser 24 that adheres the toner to the media sheet. The sheet is then either forwarded through the output rollers 26 into an output tray 28, or the rollers 26 rotate in a reverse direction to move the media sheet to a duplex path 30. The duplex path 30 directs the inverted media sheet back through the image formation process for forming an image on a second side of the media sheet.

It is worth noting that other image forming devices may implement an indirect-transfer scheme whereby a developed image is initially transferred from the photoconductive surface 51 to an intermediate transfer mechanism substrate, such as a belt or a drum, before the image is subsequently transferred to a media sheet. The embodiments disclosed herein are applicable to these types of devices as well.

Figure 2:
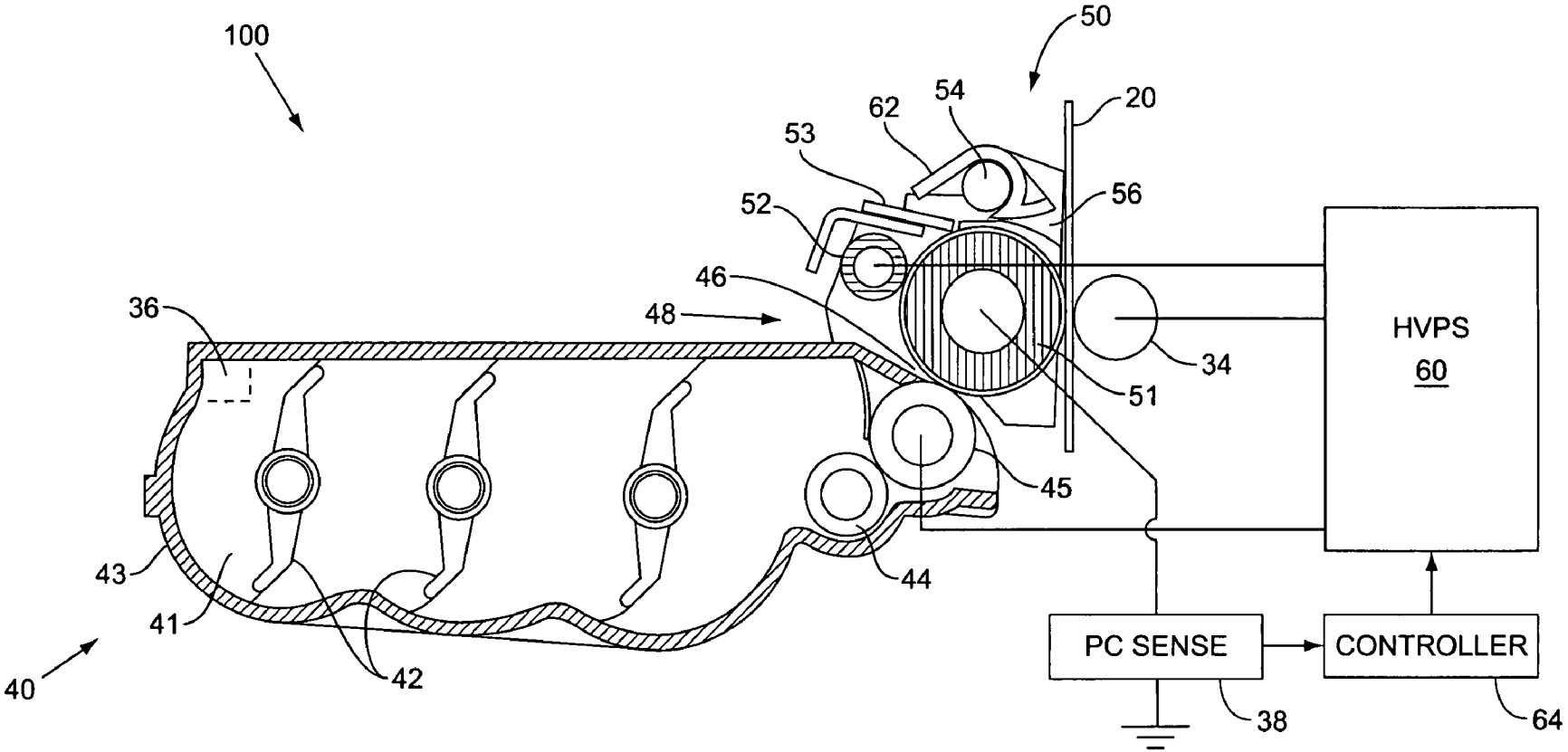
FIG. 2 is a cross-sectional view of an image forming unit and associated power supply and detection circuitry according to one embodiment of the present invention.

Further, as illustrated in FIGS. 1 and 2, the image forming units 100 comprise a developer unit 40 and a photoconductor (PC) unit 50 in at least one embodiment, but other configurations are contemplated herein. The developer unit 40, including the developer member 45, is positioned within the main body 12. The PC unit 50, including the photoconductive member 51, is also mounted within the main body 12, but is independent of the developer unit 40. Thus, the developer units 40 may be replaced independently of the PC units 50. The PC units 50 may still be replaced as needed, though likely on a less frequent basis than the developer units 40. In addition, the transport belt 20 and transfer rollers 34 may also be removable as part of a replaceable belt sub-unit. Each of these removable components is sometimes referred to as a customer replaceable unit. An access door 14 on the main body 12 of the image forming device 10 is advantageously opened to permit installation and replacement of the customer replaceable units as needed as well as to provide access to media jams within the image forming device 10.

FIG. 2 illustrates a cross-sectional view of the image forming unit 100 in the operating orientation. The developer unit 40 comprises an exterior housing 43 that forms a reservoir 41 for holding a supply of undeveloped toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The developer unit 40 is structured with the developer member 45 on an exterior section where it is accessible for contact with the photoconductive member 51 at a nip 46.

The PC unit 50 comprises the photoconductive member 51 and a charge roller 52. In one embodiment, the photoconductive member 51 is an aluminum hollow-core drum coated with one or more layers of light-sensitive organic photoconductive materials. A housing 56 forms the exterior of a portion of the photoconductor unit 50. The photoconductive member 51 is mounted protruding from the PC unit 50 to contact the developer member 45 at nip 46. Charge roller 52 is electrified to a predetermined bias by a high voltage power supply (HVPS) 60. The charge roller 52 applies an electrical charge to the surface of the photoconductive member 51. During image creation, selected portions of the surface of the photoconductive member 51 are exposed to optical energy, such as laser light, through aperture 48. Exposing areas of the photoconductive surface 51 in this manner creates a discharged latent image on the photoconductive member 51. That is, the latent image is discharged to a lower charge level than areas of the photoconductive member 51 that are not illuminated.

The developer member 45 and the toner thereon are charged to another bias level by the HVPS 60 that is advantageously set between the bias level of charge roller 52 and the discharged latent image. This charged toner is carried by the developer member 45 to the latent image formed on the surface of the photoconductive member 51. As a result of the imposed bias differences, the toner is attracted to the latent image and repelled from the remaining, higher charged portions of the photoconductive surface. At this point in the image creation process, the latent image is said to be developed.

The developed image is subsequently transferred to a media sheet being carried past the photoconductive member 51 by media transport belt 20. In the exemplary embodiment, a transfer roller 34 is disposed behind the transport belt 20 in a position to impart a contact pressure at the transfer nip. In addition, the transfer roller 34 is advantageously charged, typically to a polarity that is opposite the charged toner and charged photoconductive member 51 to promote the transfer of the developed image to the media sheet. The polarity of the transfer roller 34 is also switched periodically, typically between print jobs, to clean the transfer roller 34. This change in polarity induces the transfer of toner back towards the transport belt 20 and/or the photoconductive member 51, each of which has their own associated cleaning device (e.g., cleaner blade 53).

The cleaner blade 53 contacts the surface of the photoconductive member 51 to remove toner that remains on the photoconductive member 51 following transfer of the developed image to a media sheet passing between the photoconductive member 51 and the media transport belt 20. The residual toner is moved to a cleaner housing 62, where a waste toner auger 54 moves the waste toner out of the photoconductor unit 50 and towards a waste toner container (not shown), which may be disposed of once full.

In one embodiment, the charge roller 52, the developer member 45, and the photoconductive member 51 are all negatively biased. The transfer roller 34 is normally positively biased, except during cleaning procedures, when the polarity of the charge applied to the transfer roller 34 is temporarily switched to a negative value. Also, as discussed below, a negative pulse of the transfer roller 34 may advantageously be used to check for the presence or absence of the PC unit 50. Those skilled in the art will comprehend that an image forming unit 100 may implement polarities opposite from these.

Each developer unit 40 may include an associated sense device 36 for detecting the absence or presence of the developer unit 40 within the body 12 of the image forming device 10. The sense device 36 may be embodied as a mechanical, optical, or electrical sensor as are known in the art. However, sense device 36 may be specifically implemented as a signature button that is read by the image forming device 10. In other embodiments, the sense device 36 is identified using a corresponding sensor (not shown) located within the body 12 of the image forming device 10 that recognizes the presence or absence of the signature button.

Since the developer unit 40 is separable from the PC unit 50, sense device 36 does not indicate the presence or absence of the PC unit 50. However, the PC Sense circuit 38 shown in FIG. 2 may advantageously obviate the need for another dedicated sense device 36 or other sensing mechanism associated directly with PC unit 50. Thus, in the case of a color image forming device as shown in FIG. 1, four separate sense devices or sensing mechanisms may be eliminated. In the embodiment depicted in FIG. 2, a controller 64 includes control circuitry that is operable to direct the transmission of a signal originating from the HVPS 60 that propagates through the components and may be sensed by the PC Sense circuit 38 and controller 64 as an indication of the presence or absence of the PC unit 50. The controller 64 may be the same controller that controls the application of charge biases to the charge roller 52, developer member 45, and transfer roller 34 via the HVPS 60 during normal image forming operation. Note also that the HVPS 60 may comprise discrete power supplies for each of the charge roller 52, developer member 45, and transfer roller 34 in contrast to the multi-terminal embodiment depicted. However, it should be noted that the individual terminals of the multi-terminal embodiment of the HVPS 60 are independently controllable.

Figure 3:
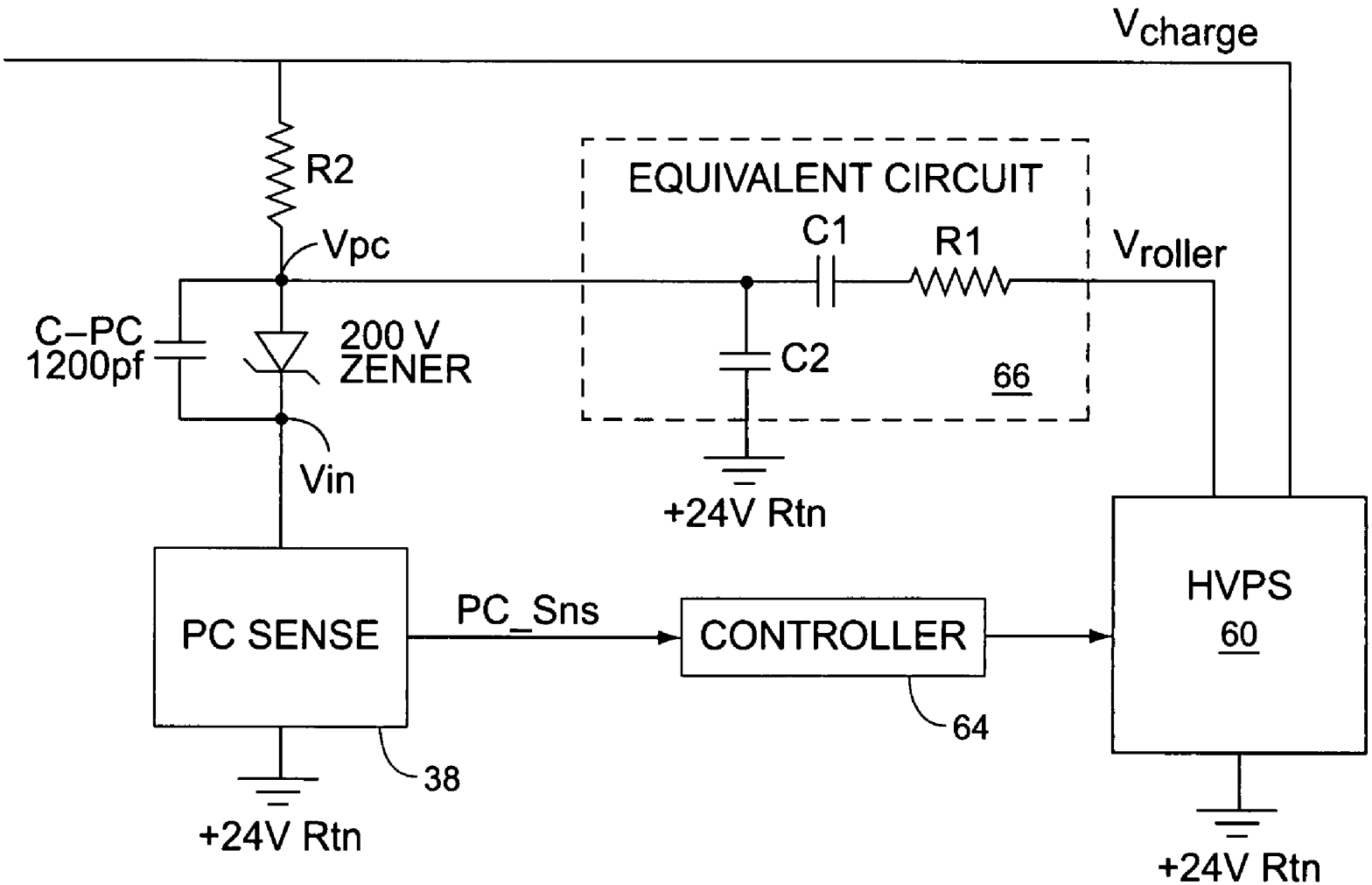
FIG. 3 is a schematic of a component detection circuit according to one embodiment of the present invention.

FIG. 3 shows a detection circuit comprising an electronic schematic representation of the exemplary components shown in FIG. 2. The HVPS 60, controller 64, and PC Sense circuitry 38 are the same as depicted in FIG. 2. $V_{charge}$ represents the charge voltage applied by the HVPS 60 to the charge roller 52 shown in FIG. 2. Similarly, $V_{roller}$ represents the charge voltage applied by the HVPS 60 to the transfer roller 34 shown in FIG. 2. The remaining components in FIG. 3 are actual or equivalent electrical components representative of the interface between the physical components shown in FIG. 2. The circuit node labeled $V_{pc}$ is the connection point between the core of the photoconductive member 51 and the HVPS 60. Here, R2 is a bias resistor that, when the charge supply $V_{charge}$ is on, provides bias current to the 200 volt zener diode to place an approximate 200 volt potential on the core of photoconductive member 51. Capacitor C-PC is a coupling capacitor that couples voltage transients from the node labeled $V_{pc}$ to the input of the PC Sense circuit, labeled $V_{in}$. The charge supply $V_{charge}$ and the associated 200 volt core potential are on during printing and off during PC sensing. In the block labeled Equivalent Circuit 66, element C2 represents the capacitance from the core of photoconductive member 51 to ground via the photoconductor coating in contact with developer roll 45, charge roll 52, and cleaner blade 53. The value of any series resistance in this equivalent circuit is small and therefore not shown. At the transfer roller 34 interface, capacitor C1 represents a composite capacitance of photoconductive member 51, transfer roller 34, and belt 20. R1 represents the series resistance attributable to the belt 20 and transfer roll 34.

Those skilled in the art will recognize that the equivalent circuit 66 shown in FIG. 3 is a non-limiting example representative of one particular configuration. Other equivalent circuits may be modeled based on actual architecture for the purpose of determining the efficacy of the diagnostic check performed in the present embodiment. For example, in an alternative embodiment, the exemplary equivalent circuit 66 may reflect an electrical interface between the photoconductive member 51 and the developer member 45 (instead of the transfer roller 34) where the model accounts for a capacitance inherent in a brush or foam construction used in some developer members 45. In general, the model provided in FIG. 3 or other models representing other configurations may be useful in predicting how a signal generated at the HVPS 60 will propagate through components for the purpose of sensing the presence or absence of one or more of the components.

Figure 4:
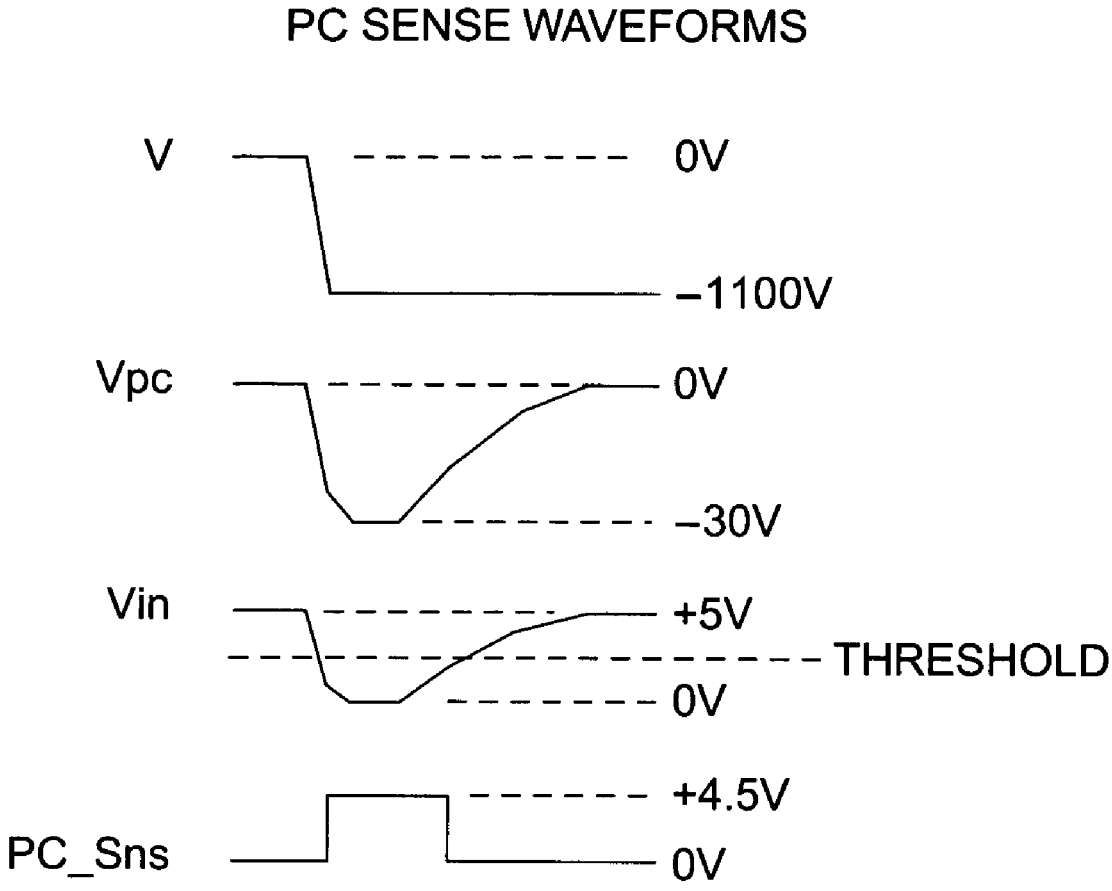
FIG. 4 is a graphical representation of various waveforms generated in one embodiment of the present invention.

The exemplary PC Sense circuit 38 generates a binary output signal PC_Sns in response to a detected input signal $V_{in}$. The controller 64 determines the presence or absence of the PC unit 50 based on the value of the binary output signal PC_Sns. During a steady-state condition, while both the bias $V_{charge}$ of charge roller 52 and the bias $V_{roller}$ of transfer roller 34 are held at 0 volts, the input signal $V_{in}$ is held at a high value of +5 volts by a low-voltage power source within the PC Sense circuit 38. If the bias $V_{charge}$ of charge roller 52 is kept at 0 volts and the bias $V_{roller}$ of transfer roller 34 is switched on, the signal change is propagated through the transfer roller 34, through the photoconductive member 51 and to the input of the PC sense circuit 38. The signal waveforms depicted in FIG. 4 show how this bias switch at the transfer roller 34 affects the instantaneous voltages at various other points in the detection circuit shown in FIG. 3. In the exemplary embodiment shown, the bias $V_{roller}$ of transfer roller 34 is switched to an input voltage value of −1100 volts. The effects of the equivalent circuit 66 may be seen by noticing a lower (magnitude) voltage $V_{pc}$ at the surface of the photoconductive member 51. Note, however, that the drop in the voltage $V_{pc}$ at the surface of the photoconductive member 51 is momentary and that the value of $V_{pc}$ returns to zero due to the effects of the equivalent circuit 66. Consequently, the input pulse $V_{roller}$ may be released back to 0 volts at some point shortly after being switched on, instead of being held on as indicated in FIG. 4. The duration for which the input signal $V_{roller}$ is held on may be varied so long as the output signal PC_Sns accurately reflects the detection of an input pulse. Alternatively, the signal $V_{roller}$ may comprise a series of pulses.

A similar change in voltage is passed along to the core of the photoconductive member 51 and, consequently, to the input $V_{in}$ of the PC Sense circuit 38. For the period of time that the input signal $V_{in}$ drops below a predetermined threshold, the exemplary PC Sense circuit 38 generates a high output signal PC_Sns, which the controller 64 detects as an indication that the PC unit 50 is properly installed in the image forming device 10. The same type of diagnostic check may be performed for each PC unit 50 in the image forming device. Similarly, the polarity of the PC_Sns output signal may be reversed in alternative embodiments.

Figure 5:
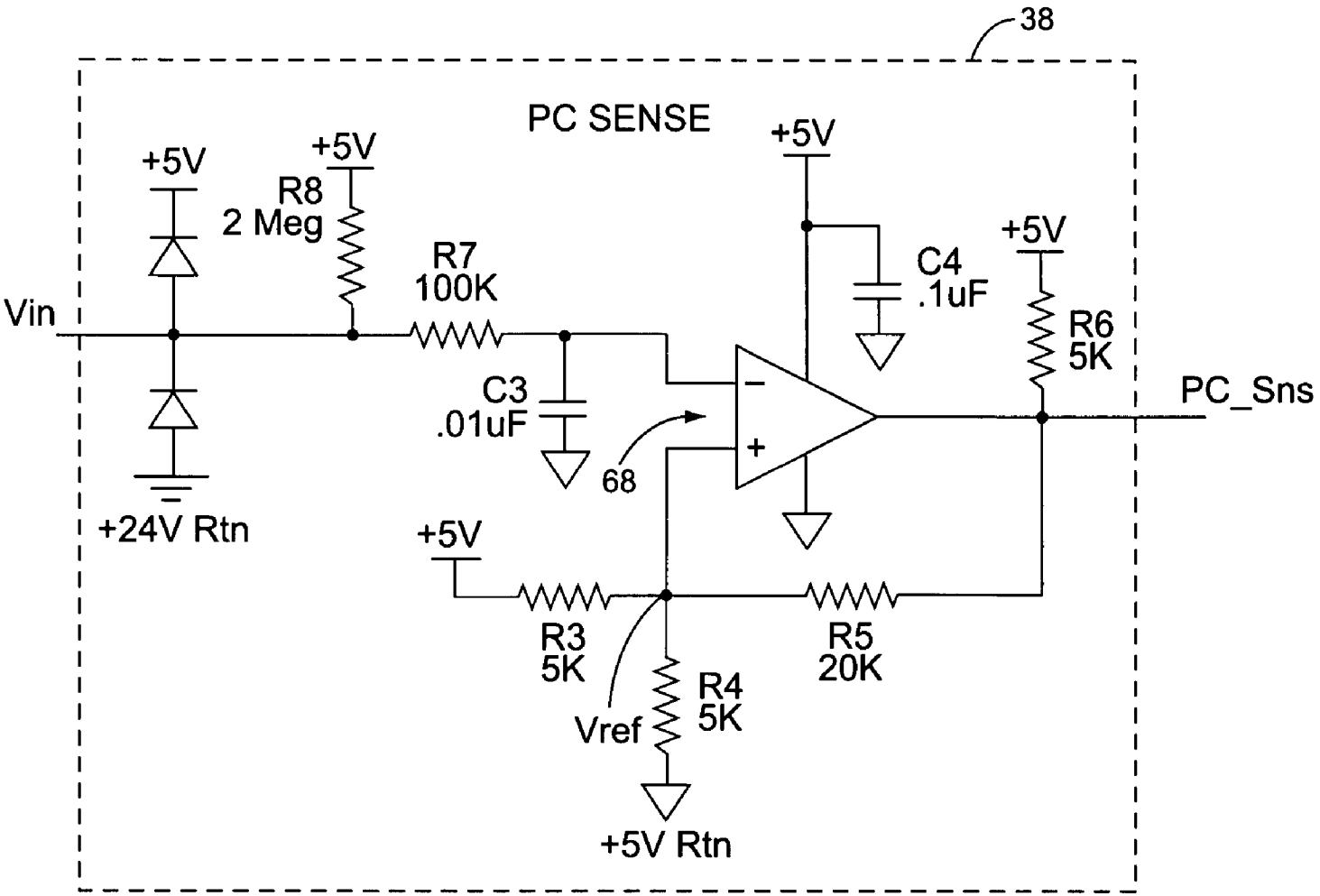
FIG. 5 is a schematic of a component sense circuit according to one embodiment of the present invention.

FIG. 5 shows one embodiment of a PC Sense circuit 38 adapted for use in the detection circuit of FIG. 3. The depicted PC Sense circuit 38 comprises an inverting comparator 68 with hysteresis operative to compare a filtered input signal $V_{in}$ against a reference voltage $V_{ref}$. Hysteresis offers the advantage of separating the up-going and down-going switching points of the comparator 68 so that, once a transition has started, the input $V_{in}$ must undergo a significant reversal before the reverse transition of the output PC_Sns can occur. In addition, the input $V_{in}$ is smoothed by an RC filter formed by the resister R7 and capacitor C3. The reference voltage $V_{ref}$ is established by the voltage divider formed by resistors R3 and R4. In the exemplary embodiment, the reference voltage is established at about 2.5 volts. Thus, when in the filtered version of input voltage $V_{in}$ falls below this threshold, the inverting comparator 68 generates the high PC_Sns pulse shown in FIG. 4. Of course, the exemplary PC Sense circuit 38 is just one example of a sensing circuit that generates an output PC_Sns indicative of the presence or absence of the PC unit 50. Those skilled in the art will recognize a variety of other solutions that may include analog or digital solutions. For instance, transistor devices or logic gates may also perform the same or other desired functions dependent on the specifics of a particular application.

One application of the exemplary method and device for determining the presence or absence of the PC unit 50 in the exemplary image forming unit 100 shown in FIG. 2 is to determine whether the appropriate components are installed for a selected printing mode. For example, it is generally desirable, and possibly necessary, that all four image forming units 100 be present in a color image forming device 10 as shown in FIG. 1 for a full color printing mode. The procedure outlined in FIG. 6 presents one approach to determining whether all four image forming units 100, including the respective developing units 40 and PC units 50, are present in an image forming device 10.

Figure 6:
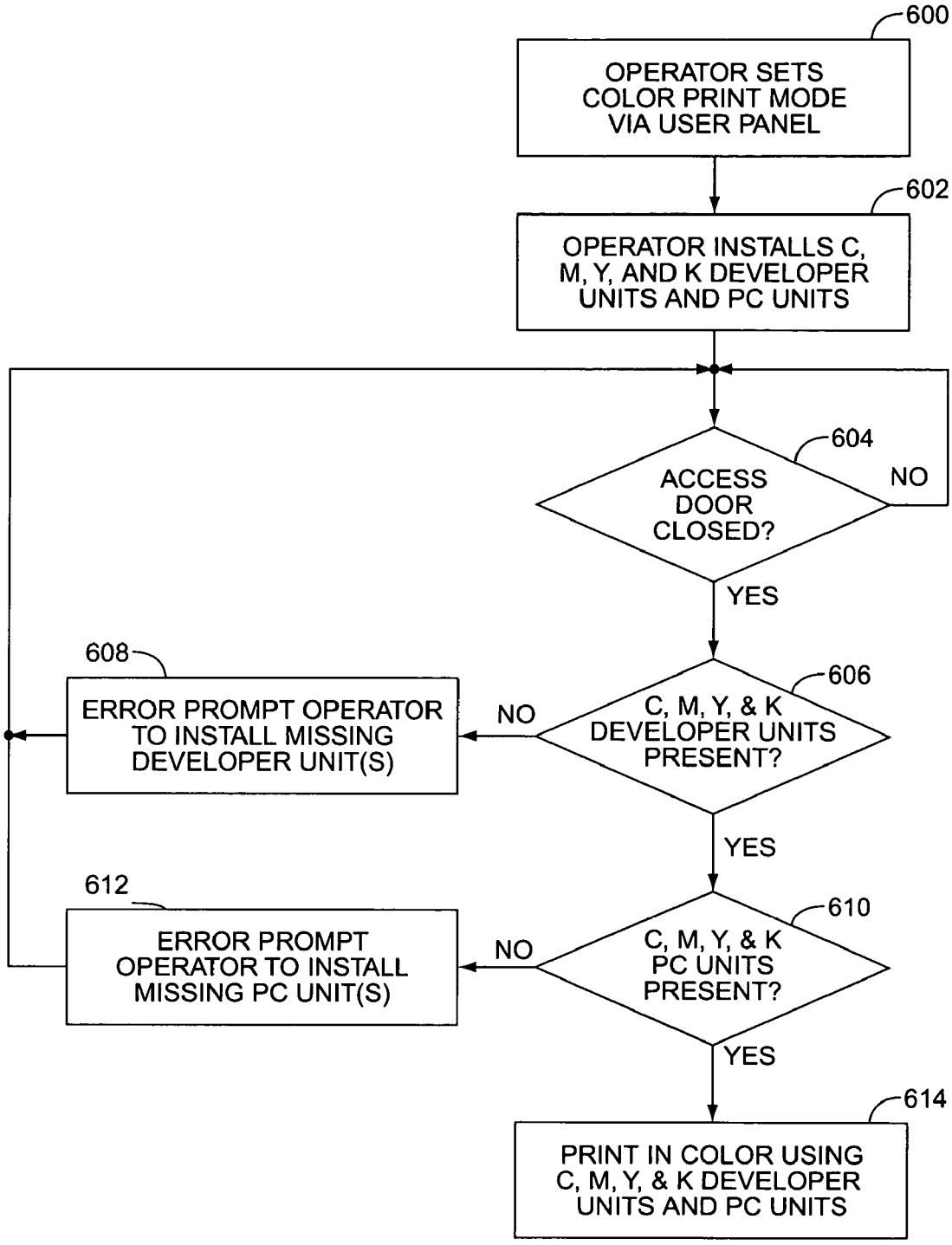
FIG. 6 is a flow diagram showing a color print mode diagnostic check according to one embodiment of the present invention.

As shown in FIG. 6, the operator sets a color print mode (Step 600), typically via the user panel of the image forming device 10. The print mode may also be set using an associated driver on a host computer or other server. If necessary, such as during initial product setup, the operator installs the developer units 40 and PC units 50 into the image forming device 10 (Step 602). Controller 64 within the image forming device 10 then determines whether the access door 14 is closed (Step 604). If the access door 14 is not properly closed, the operator may be prompted to take corrective action. If the access door 14 is closed, the controller 64 determines whether the developer units 40 for each color toner are present in the image forming unit (Step 606). In the exemplary embodiment, the presence or absence of the developer units 40 is determined using the sense device 36 associated with each developer unit 40. If one or more developer units 40 are absent, the controller 64 generates an error signal and prompts the operator to install the missing developer unit(s) 40 (Step 608).

Similarly, the controller 64 determines whether the PC units 50 for each color toner are present in the image forming unit (Step 610). In the exemplary embodiment, the presence or absence of the PC units 50 is determined using the PC sense circuitry 38 associated with each PC unit 50. If one or more PC units 50 are absent, the controller 64 generates an error signal and prompts the operator to install the missing PC unit(s) 50 (Step 612). If the controller 64 determines that all developer units 40 and PC units 50 are present, the image forming device 10 proceeds to generate full color images (Step 614). It is worth noting that the procedure outlined in FIG. 6 may be scaled down to a single-color image forming device 10 with a corresponding check for the presence of the components of a single image forming unit 100.

Figure 7:
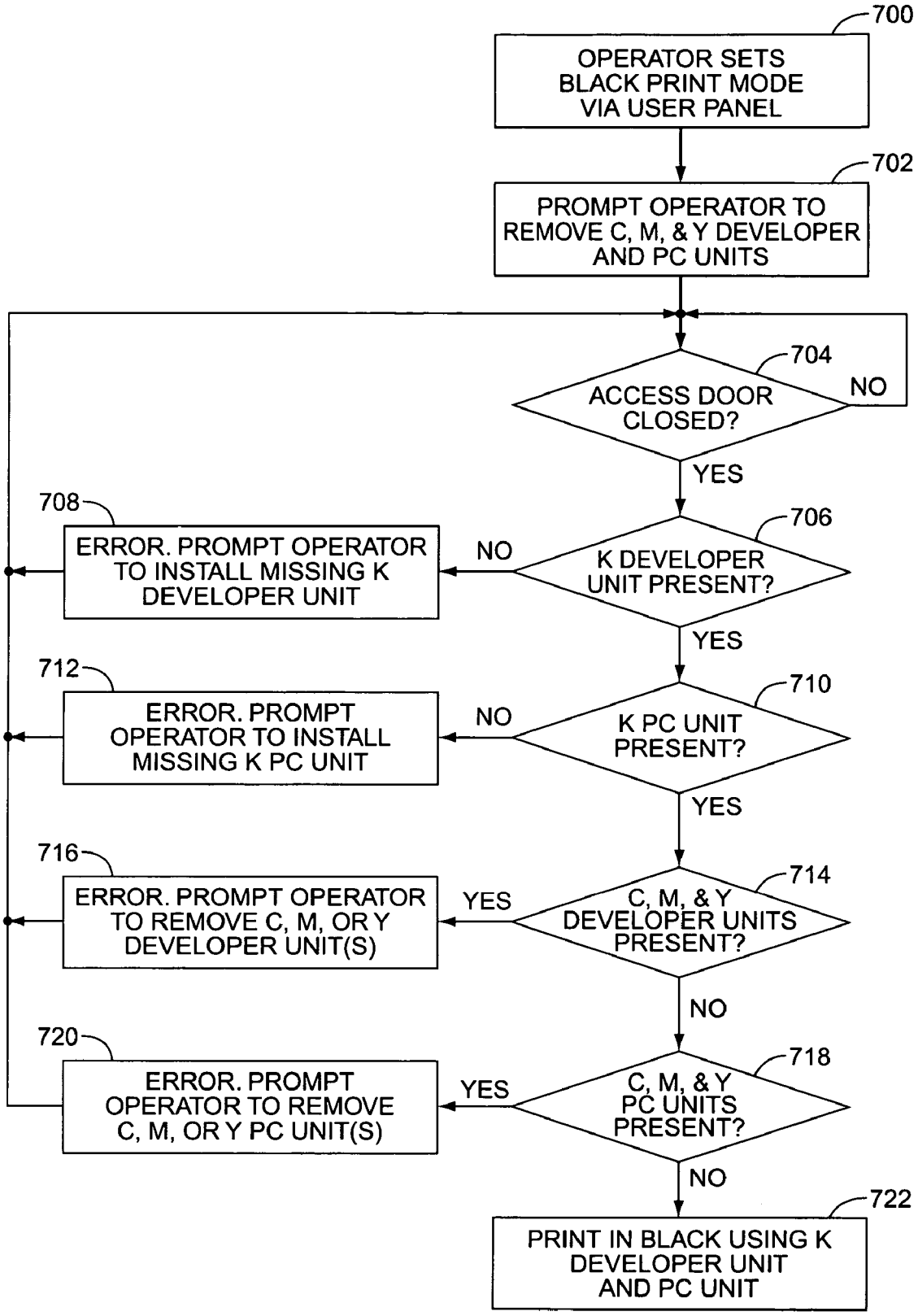
FIG. 7 is a flow diagram showing a black print mode diagnostic check according to one embodiment of the present invention.

A similar procedure is outlined in FIG. 7 for determining if a proper configuration exists for a black-only printing mode in a color image forming device 10. That is, FIG. 7 presents one approach to determining whether a black image forming unit 100, including its respective developing unit 40 and PC unit 50, are present in an image forming device 10. At approximately the same time, the controller 64 verifies that the non-black (e.g., Cyan, Magenta, Yellow) developing units 40 and PC units 50 are removed from the system.

Specifically, the operator sets a black print mode (Step 700), typically via the user panel of the image forming device 10. The print mode may also be set using an associated driver on a host computer or other server. If necessary, such as during initial product setup, the operator installs the black developer units 40 and PC units 50 into the image forming device 10. Alternatively or additionally, the operator may be prompted to remove the non-black developer units 40 and PC units 50 (Step 702). Controller 64 within the image forming device 10 then determines whether the access door 14 is closed (Step 704). If the access door 14 is not properly closed, the operator may be prompted to take corrective action. If the access door 14 is closed, the controller 64 determines whether the black developer unit 40 is present in the image forming unit (Step 706). In the exemplary embodiment, the presence or absence of the black developer unit 40 is determined using the sense device 36 associated with the black developer unit 40. If the black developer unit 40 is not installed, the controller 64 generates an error signal and prompts the operator to install the missing developer unit 40 (Step 708).

Similarly, the controller 64 determines whether the black PC unit 50 is present in the image forming unit (Step 710). In the exemplary embodiment, the presence or absence of the black PC unit 50 is determined using the PC sense circuitry 38 associated with the black PC unit 50. If the black PC unit 50 is absent, the controller 64 generates an error signal and prompts the operator to install the missing PC unit 50 (Step 712).

The controller 64 then proceeds to determine whether the non-black (e.g., C, M, Y) developer units 40 are present in the image forming unit (Step 714). In the exemplary embodiment, the presence or absence of the non-black developer units 40 is determined using the sense device 36 associated with each non-black developer unit 40. If one or more non-black developer units 40 are installed, the controller 64 generates an error signal and prompts the operator to remove the installed non-black developer units 40 (Step 716).

Similarly, the controller 64 determines whether the non-black PC units 50 are present in the image forming unit (Step 718). In the exemplary embodiment, the presence or absence of the black PC units 50 is determined using the PC sense circuitry 38 associated with each non-black PC unit 50. If the non-black PC units 50 are present, the controller 64 generates an error signal and prompts the operator to remove the non-black PC unit(s) 50 (Step 720). If the controller 64 determines that the desired developer units 40 and PC units 50 are present, the image forming device 10 proceeds to generate black or grayscale images using black toner (Step 722).

The embodiments disclosed thus far have contemplated the use of a sense device 36 associated with each developer unit 40. However, the technique disclosed herein for detecting the presence or absence of the PC unit 50 may be equally applicable to the developer unit 40. For instance, referring to FIG. 2, an electrical coupling exists between the developer member 45 and the photoconductive member 51. Thus, a signal transmitted from the HVPS 60 to the developer member 45 may propagate through the photoconductive member 51 and ultimately be sensed by a PC Sense circuit 38. Alternatively, a sense circuit similar to PC Sense circuit 38 may be configured to detect the presence or absence of the developer unit 40 alone. The same may be accomplished for any removable component in the image forming device 10. Thus, the sense device 36 associated with each developer unit 40 may be eliminated in lieu of a scheme that uses a HVPS 60 signal and an associated sense circuit.

Thus, the presence or absence of each of the removable components (e.g., developer unit 40, PC unit 50, transfer roller 34 and belt 20) can be verified using the HVPS 60 signal and PC Sense circuit 38. An exemplary approach is to transmit the characteristic HVPS 60 signal through two or more removable components to verify the existence of each component. The absence of a component in the detection path will create a large impedance and the PC Sense circuit 38 will not generate a detection signal (e.g., a high value for PC_Sns as shown in FIG. 4). One approach to detecting the presence or absence of the components of the image forming unit 100 shown in FIG. 2 is to send a first HVPS 60 signal through the developer member 45 to check for the presence and proper installation of the developer unit 40 and the PC unit 50. Then a second HVPS 60 signal may be transmitted through the transfer roller 34 to check for the presence and proper installation of the transfer roller 34, belt 20, and PC unit 50. The order in which the signals are sent from the HVPS 60 may be reversed if desired.

The exemplary image forming unit 100 shown in FIG. 2 uses contact development technology—a scheme that implements a physical contact between components to promote the transfer of toner. The techniques disclosed herein for detecting the presence or absence of a removable component may also be applicable to devices that jump-gap development technology. That is, the methodology described herein may be applied to devices that are in close proximity, but not in physical contact with one another, with the understanding that the capacitive effects of the interface between the non-touching components decrease. Thus, a detection input signal from the HVPS 60 should be suitably large to overcome such effects. Those skilled in the art will comprehend the adjustments to the equivalent circuit 66, PC sense circuit 38, and related controller 64 that should be made for these types of devices.

Those skilled in the art should also appreciate that the control circuitry associated with controller 64 shown in the Figures for implementing the present invention may comprise hardware, software, or any combination thereof. For example, circuitry for generating an error or interrupting image formation if a component is not detected may be a separate hardware circuit, or may be included as part of other processing hardware. More advantageously, however, the processing circuitry in these devices is at least partially implemented via stored computer program instructions for execution by one or more computer devices, such as microprocessors, Digital Signal Processors (DSPs), ASICs or other digital processing circuits included in the controller 64. The stored program instructions may be stored in electrical, magnetic, or optical memory devices, such ROM and RAM modules, flash memory, hard disk drives, magnetic disc drives, optical disc drives and other storage media known in the art.

The present invention may be carried out in other specific ways than those herein set forth without departing from the scope and essential characteristics of the invention. For instance, whereas a single controller 64 and PC Sense circuit 38 is shown in FIGS. 2 and 3 associated with each image forming unit 100, a single controller 64 and PC Sense circuit 38 may be adapted to sense the presence of the components of a plurality of image forming units 100. As an example, a PC Sense circuit 38 may be coupled to a shared photoconductive core bias node. Additionally, the detection scheme disclosed herein may be incorporated in a variety of image forming devices including, for example, printers, fax machines, copiers, and multi-functional machines including vertical and horizontal architectures as are known in the art of electrophotographic reproduction. The present embodiments are, therefore, to be considered in all respects as illustrative and not restrictive, and all changes coming within the meaning and equivalency range of the appended claims are intended to be embraced therein.

What is claimed is:

1. A method of detecting the presence or absence of a removable cartridge in an image forming device comprising:

directing a power supply pulse from a power supply to a terminal location serially through a toner transfer member and a photoconductive member in the removable cartridge; and determining whether the removable cartridge is present or absent by detecting, at the terminal location, whether the power supply pulse propagates through the removable cartridge.

2. The method of claim 1 wherein detecting whether the power supply pulse propagates through the removable cartridge comprises configuring the image forming device to include a detection circuit having a detection input that is capacitively coupled to the power supply if the removable cartridge is installed and monitoring a detection signal provided by an output of the detection circuit for a signal level change in coordination with detecting the power supply pulse.

3. The method of claim 1 further comprising:

receiving a command to operate in a designated one of a plurality of imaging modes; and creating images in the designated imaging mode if the removable component is associated with the designated imaging mode and is properly installed in said image forming device.

4. The method of claim 3 further comprising interrupting the process of creating images in the designated imaging mode if the removable component not associated with the designated imaging mode is properly installed in said image forming device.

5. The method of claim 3 further comprising interrupting the process of creating images in the designated imaging mode if the removable component associated with the designated imaging mode is not properly installed in said image forming device.

6. The method of claim 3 wherein the designated imaging mode is a black-only printing mode.

7. The method of claim 3 wherein the designated imaging mode is a color printing mode.

8. In an image forming device, a method of detecting the presence or absence of components of an image forming unit comprising:

transmitting a test signal serially through a toner transfer member and a photoconductive member in a removable component of said image forming unit;

conditionally sensing a propagation of the test signal through the removable component when the removable component is properly installed in said image forming device; and generating a detection signal indicating the presence of the removable component if the propagation of the test signal through the removable component is sensed.

9. The method of claim 8 further comprising generating a detection signal indicating the absence of the removable component if the propagation of the test signal through a second removable component is sensed.

10. The method of claim 8 wherein transmitting a test signal through a removable component of said image forming unit comprises turning on a power supply.

11. The method of claim 8 further comprising transmitting the test signal through a second removable component of said image forming unit and generating a detection signal indicating the presence of the removable components if the propagation of the test signal through the removable components is sensed.

12. An image forming device comprising:

one or more image forming units, each of the one or more image forming units having a removable cartridge, the removable cartridge comprising a photoconductive member;

a power supply adapted to transmit a test pulse to the removable cartridge along a serial path commencing at the power supply, through the photoconductive member, and terminating at an electrical return; and sense circuitry coupled along the serial path, the sense circuitry adapted to sense the transmission of the test pulse to the removable cartridge when the removable cartridge is installed in the image forming device, the sense circuitry further adapted to generate a detection signal indicating the presence of the removable cartridge when the test pulse is sensed.

13. The image forming device of claim 12 wherein the sense circuitry is disposed between the removable cartridge and the electrical return.

14. The image forming device of claim 12 wherein the power supply is adapted to transmit the test pulse to the photoconductive member serially via a toner transfer member.

15. The image forming device of claim 14 wherein the toner transfer member is disposed in a separately removable second cartridge, the sense circuitry adapted to sense the transmission of the test pulse when each of removable cartridges are installed in the image forming device.

16. The image forming device of claim 14 wherein the toner transfer member is a transfer roller.

17. The image forming device of claim 14 wherein the toner transfer member is a developer member.

18. The image forming device of claim 12 wherein the power supply comprises a multi-terminal power supply adapted to apply a bias to multiple components in each of the one or more image forming units, the power supply adapted to transmit the test pulse to the removable cartridge along one terminal while the remaining terminals are off.

19. An image forming device comprising:

an image forming unit comprising a removable cartridge having a photoconductive member and an associated toner transfer member, the toner transfer member and the photoconductive member establishing an electrical coupling when the removable cartridge is installed in the image forming device;

a power supply adapted to apply a predetermined input signal to the toner transfer member; and a detection circuit coupled to the photoconductive member, the detection circuit adapted to generate an output signal indicative of the presence or absence of the electrical coupling based in part on whether the predetermined input signal is sensed at the photoconductive member.

20. The image forming device of claim 19 further comprising a controller adapted to halt operation of the image forming device if the detection circuit generates an output signal indicative of the absence of the electrical coupling between the toner transfer member and the photoconductive member.

21. The image forming device of claim 20 wherein the image forming device is configured to operate in a designated one of a plurality of color modes, the designated color mode requiring the absence of the removable cartridge, the controller further adapted to halt operation of the image forming device if the detection circuit generates an output signal indicative of the presence of the electrical coupling if the image forming device is configured to operate in the designated color mode.

22. The image forming device of claim 19 wherein the associated toner transfer member is a transfer roller.

23. The image forming device of claim 19 wherein the associated toner transfer member is a developer member.

* * * * *